US005135430A

United States Patent [19]

Jordan et al.

[11] Patent Number: 5,135,430

[45] Date of Patent: Aug. 4, 1992

[54] DEPILATION APPARATUS

[75] Inventors: Hermann Jordan, Maria Saal; Günther Schmid, Ferlach, both of Austria

[73] Assignee: U. S. Philips Corporation, New York, N.Y.

[21] Appl. No.: 814,201

[22] Filed: Dec. 20, 1991

Related U.S. Application Data

[63] Continuation of Ser. No. 696,440, May 6, 1991, abandoned.

[30] Foreign Application Priority Data

May 17, 1990 [EP] European Pat. Off. ..... 90201250.9

[51] Int. Cl.[5] ..... A61B 17/00

[52] U.S. Cl. ..... 452/86; 452/83; 452/101; 452/102; 606/133

[58] Field of Search ..... 452/86, 83, 71, 101, 452/102, 105, 133, 142; 606/133

[56] References Cited

U.S. PATENT DOCUMENTS

| | | | |
|---|---|---|---|
| 1,006,304 | 10/1911 | Smith | 452/102 |
| 3,911,530 | 10/1975 | Kalfsbeek et al. | 452/83 |
| 4,041,122 | 8/1991 | Schneider et al. | 606/133 |
| 4,079,741 | 3/1978 | Daar et al. | 452/102 |
| 5,041,123 | 8/1991 | Oliveau et al. | 606/133 |

FOREIGN PATENT DOCUMENTS 345876 6/1989 European Pat. Off. .

*Primary Examiner*—Willis Little
*Attorney, Agent, or Firm*—Ernestine C. Bartlett

[57] ABSTRACT

The invention relates to a depilation apparatus, in which a driving roller (3) and a drive roller (4) are provided with tooth means (5, 6) and form a roller pair, the rollers performing a rotary movement which is directed into the interior of the apparatus at the location where they interengage circumferentially. The driven roller (4) of each roller pair has teeth (5) along its entire circumference but the driving roller (3) has teeth only along part of its circumference, so that the rollers intermesh only during part of a revolution of the driving roller.

8 Claims, 3 Drawing Sheets

DEPILATION APPARATUS

This is a continuation of application Ser. No. 696,440, filed May 6, 1991, now abandoned.

FIELD OF THE INVENTION

The invention relates to a depilation apparatus, in which a driving roller and a drive roller are provided with tooth means and form a roller pair, the rollers performing a rotary movement which is directed into the interior of the apparatus at the location where they interengage circumferentially.

BACKGROUND OF THE INVENTION

Such a depilation apparatus is disclosed in EP-PA 89201397.0. With this known depilation apparatus it is not unlikely that the skin is caught between the roller pair, so that generally a skin guard has to be used, for example in the form of a grille. However, short hairs are then no longer caught.

SUMMARY OF THE INVENTION

It is an object of the invention to provide a solution to this problem. According to the invention this is achieved in a depilation apparatus of the type defined in the opening paragraph in that the driven roller of each roller pair is toothed along its entire circumference but the driving roller is toothed only along part of its circumference, so that the rollers intermesh only during part of a revolution of the driving roller.

Further characteristic features of the invention include embodiments in which the driving roller has only one tooth; and/or the driving roller has a plurality of teeth; and/or the driving roller has a plurality of teeth arranged in one group on the circumference of the roller; and/or at least one depilation roller is movably supported and is urged towards the adjacent depilation roller by spring action.

BRIEF DESCRIPTION OF THE DRAWINGS

Embodiments of the invention will now be described in more detail, by way of example, with reference to the drawings.

DETAILED DESCRIPTION OF THE PREFERRED EMBODIMENTS

Figure 1:
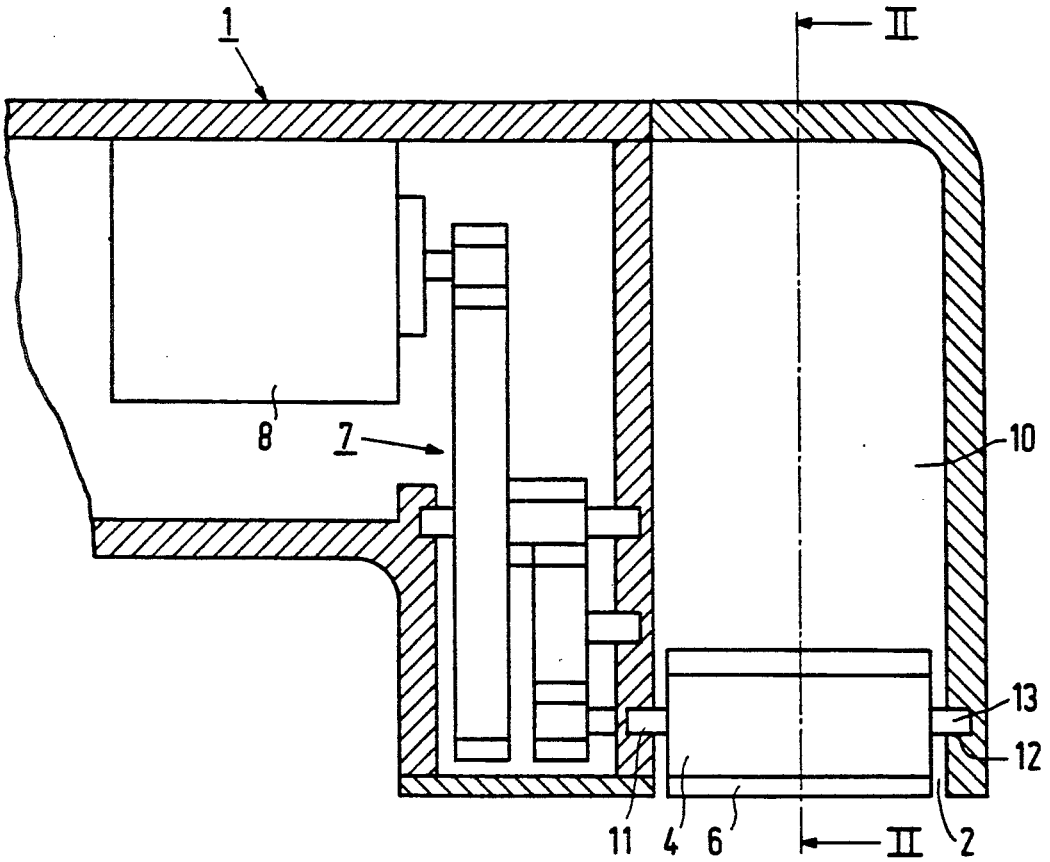
FIG. 1 is a longitudinal sectional view showing a part of a depilation apparatus.
Figure 2:
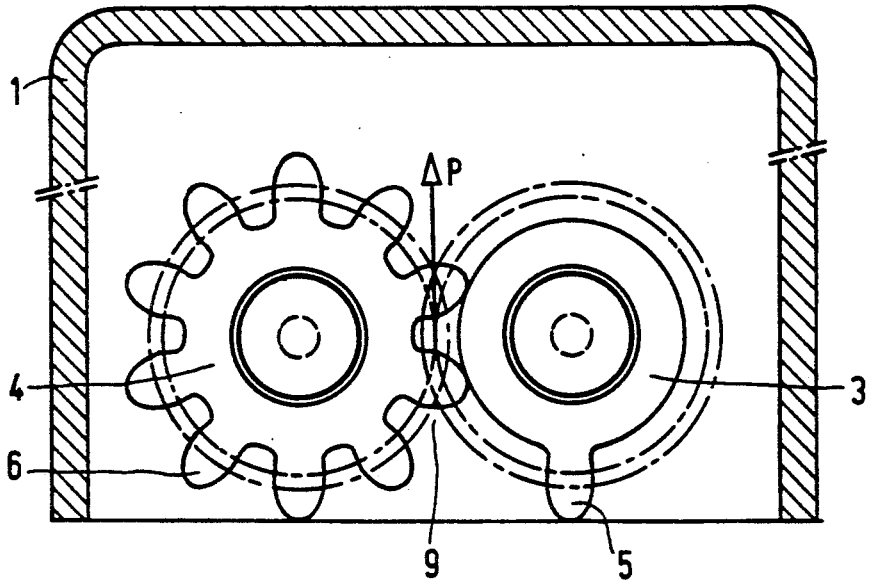
FIG. 2 is an enlarged-scale sectional view taken on the line II—II in FIG. 1.

In FIGS. 1 and 2, the housing 1 of a depilation apparatus has a housing opening 2, at the location of which a driving roller 3 and a drive roller 4 are arranged. The driving roller 3 has tooth means 5 over only part of its circumference and the driven roller has tooth means 6 over its entire circumference. The driving roller 3 can be driven by means of a motor 8 via a multi-stage gear mechanism 7 and the driven roller 4 is driven by the driving roller 3 via the tooth means 5 and 6. The rollers 3 and 4 then perform a rotary movement which at the location where they interengage circumferentially is directed into the interior of the apparatus, (see the arrow P). In this way the roller pair 3, 4 is capable of gripping and extracting a hair projecting into the area 9. The rollers then feed the hair thus extracted into the adjacent collecting chamber 10.

The tooth means 5 of the driving roller 3 comprises only one tooth, so that the rollers 3, 4 intermesh only during part of a revolution of the driving roller 3. When the tooth means 5 and 6 are not in mesh the driven roller 4 remains stationary, for example as a result of the friction in the bearings 11, 12 of the spindle 13 of this roller or the contact of the roller 4 with the skin. This considerably reduces the likelihood of the skin being caught between the rollers 3, 4 and thus being injured.

Moreover, the power consumption of the apparatus is reduced, which is of particular significance when the power source of the apparatus is a battery.

When a hair has been caught by the tooth means 5, 6 the surrounding skin is also pulled slightly in the direction P. As the driving roller 3 has only one tooth there is no risk of this skin portion being caught between a following tooth of the roller 3 and the tooth means 6 of the roller 4. Consequently, this also substantially eliminates the risk of skin injury.

Figure 3:
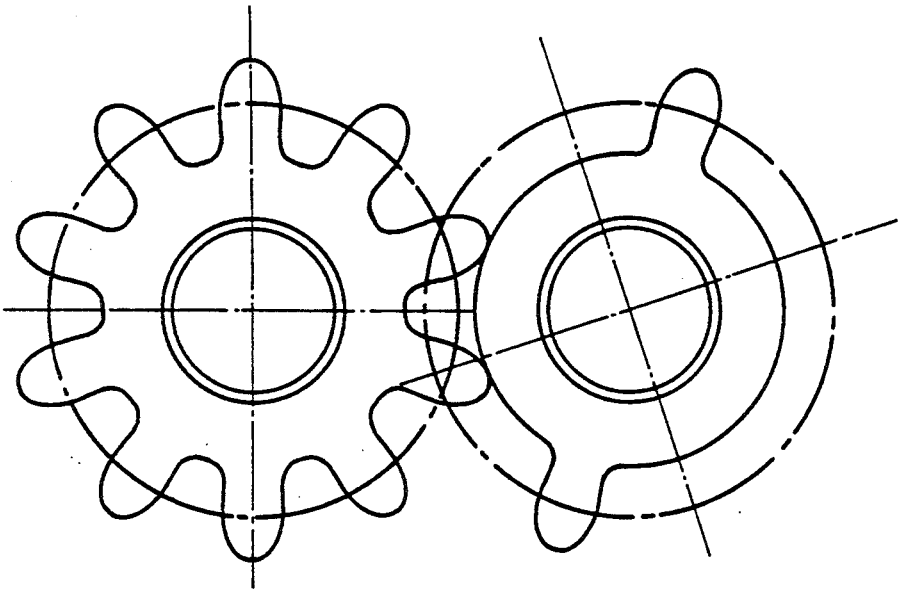
FIGS. 3 and 4, in the same way as FIG. 2, show modifications of the roller pair.

Alternatively, the driving roller 3 may comprise a plurality of teeth 14 (FIG. 3), which may be spaced, for example, regularly along the circumference of this roller.

Figure 4:
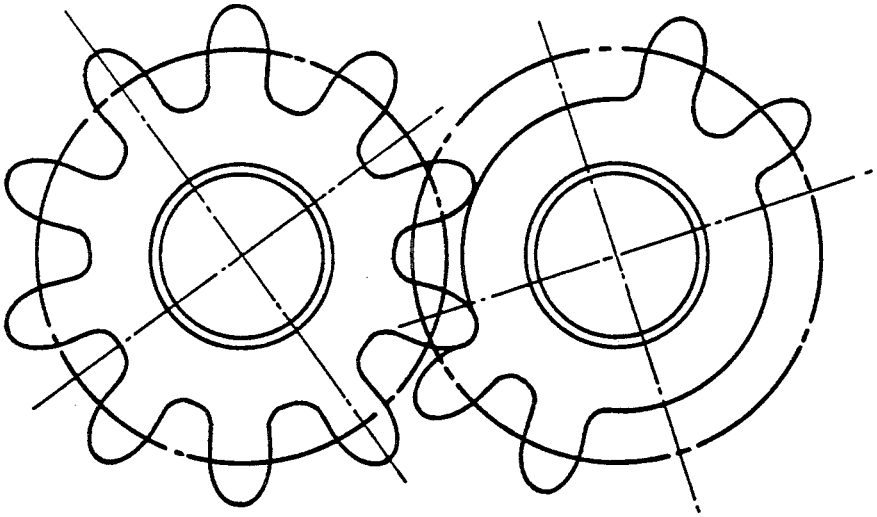

The driving roller 3 may comprise a plurality of teeth 14 arranged in one group along the roller circumference or arranged in groups along the circumference of the roller 3 (FIG. 4).

The teeth may extend rectilinearly or helically in the axial direction of the rollers 3, 4 and may have an involute or other cross-sectional profile.

Figure 5:
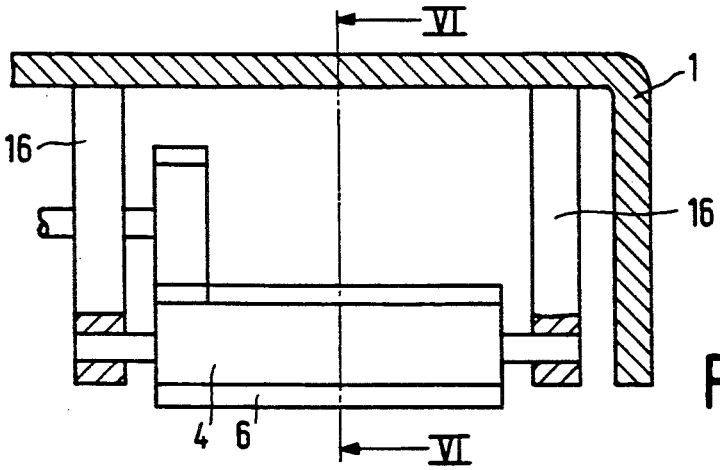
FIG. 5, in the same way as FIG. 1, shows a depilation apparatus in which the driven roller is supported on pivotable arms.
Figure 6:
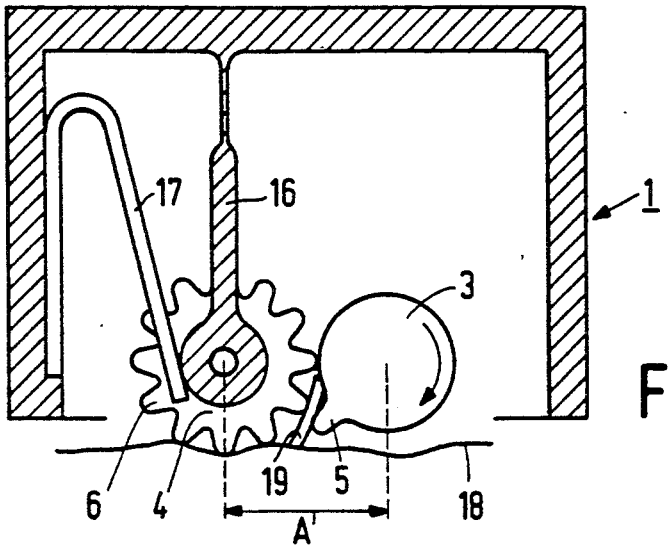
FIGS. 6 and 7 are sectional views taken on the line VI—VI in FIG. 5.
Figure 7:
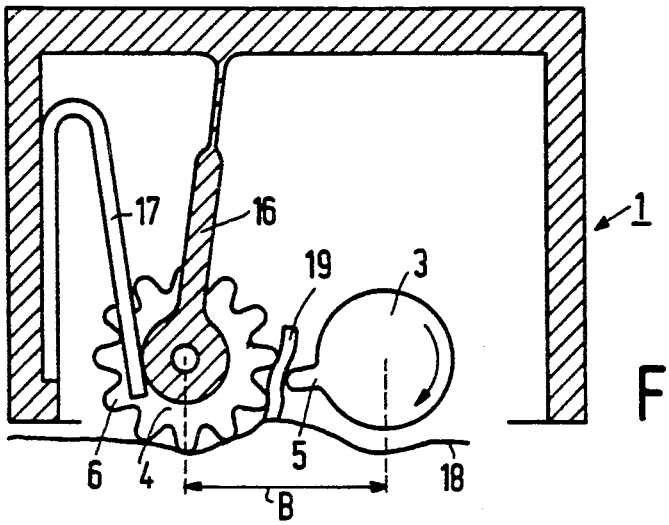

In the embodiment shown in FIGS. 5-7, the driven roller 4 is supported on pivotable arms 16. A blade spring 17 cooperates with each of these pivotable arms to urge the driven roller 4 towards the driving roller 3. This results in a proper circumferential cooperation between the rollers 3 and 4, thereby ensuring that the hairs to be removed are caught and clamped between the rollers and are thus extracted.

When the tooth means 5, 6 do non intermesh the axial distance A (FIG. 6) between the rollers 3 and 4 is minimal, so that the clearance between the rollers at the location 9 (indicated in FIG. 2) is minimal. This minimizes the risk of the skin 18 being gripped and caught between the rollers. A hair 19 can be gripped very close to the skin, so that short hairs can also be extracted.

In this embodiment the axial distance increases when the tooth means 5 and 6 intermesh.

When the hair 19 is caught between the rollers 3 and 4 (FIG. 7) the axial distance consequently increases to B, so that a larger clamping force is exerted on the hair.

We claim:

1. A depilation apparatus, in which a driving roller and a drive roller are provided with tooth means and form a roller pair, the rollers performing a rotary movement which is directed into the interior of the apparatus at the location where they interengage circumferentially, wherein the driven roller of each roller pair is toothed along its entire circumference but the driving roller is toothed only along part of its circumference, so that the rollers intermesh only during part of a revolution of the driving roller.

2. A depilation apparatus as claimed in claim 1, wherein the driving roller has only one tooth.

3. A depilation apparatus as claimed in claim 1, wherein the driving roller has a plurality of teeth.

4. A depilation apparatus as claimed in claim 1, wherein the driving roller has a plurality of teeth arranged in one group on the circumference of the roller.

5. A depilation apparatus as claimed in claim 1, wherein at least one depilation roller is movably supported and is urged towards the adjacent depilation roller by spring action.

6. A depilation apparatus as claimed in claim 2 wherein at least one depilation roller is movably supported and is urged towards the adjacent depilation roller by spring action.

7. A depilation apparatus as claimed in claim 3 wherein at least one depilation roller is movably supported and is urged towards the adjacent depilation roller by spring action.

8. A depilation apparatus as claimed in claim 4 wherein at least one depilation roller is movably supported and is urged towards the adjacent depilation roller by spring action.

* * * * *